US005664417A

United States Patent [19]

Wilke et al.

[11] Patent Number: 5,664,417

[45] Date of Patent: Sep. 9, 1997

[54] CONTROL VALVE FOR PRIME MOVER SPEED CONTROL IN HYDRAULIC SYSTEMS

[75] Inventors: Raud A. Wilke, Dousman; David A. Dornbach; Leif Pedersen, both of Waukesha, all of Wis.

[73] Assignee: HUSCO International, Inc., Waukesha, Wis.

[21] Appl. No.: 618,733

[22] Filed: Mar. 20, 1996

[51] Int. Cl.[6] ..... F15B 13/04

[52] U.S. Cl. ..... 60/327; 60/431; 60/434; 137/596; 137/625.68

[58] Field of Search ..... 60/327, 431, 434; 137/596, 625.68

[56] References Cited

U.S. PATENT DOCUMENTS

| | | | |
|---|---|---|---|
| 3,685,540 | 8/1972 | Wilke | 137/596.13 |
| 4,693,272 | 9/1987 | Wilke | 137/596 |
| 4,862,691 | 9/1989 | Peschel | 60/431 |
| 5,000,001 | 3/1991 | Christensen et al. | 60/450 |
| 5,138,837 | 8/1992 | Obertrifter | 60/426 |
| 5,146,747 | 9/1992 | Sugiyama et al. | 60/452 |
| 5,415,199 | 5/1995 | Claudinon et al. | 137/596 |

*Primary Examiner*—Gerald A. Michalsky
*Attorney, Agent, or Firm*—Quarles & Brady

[57] ABSTRACT

A control valve (10) is provided for mobile or stationary hydraulic equipment for automatically increasing or decreasing speed of a prime mover in response to operation of a hand lever to extend a hydraulic cylinder. A prime mover speed control valve (42) is integrated with a spool (12) in a single housing (10) for the purpose of simultaneously controlling the supply of fluid to a hydraulic cylinder (16) and to a cylinder (61) controlling prime mover speed. When the spool (12) is in the "CYLINDER EXTEND" or "NEUTRAL" position for the implement cylinder, a hydraulic control signal is provided from port (55) to the prime mover control cylinder (61) to signal increased prime mover speed and increased output from a hydraulic pump (17). When the spool (12) is in the "CYLINDER RETRACT" position for the implement cylinder (16), the spool (12) blocks the signal from port (55) while allowing fluid to drain from the implement cylinder (16) to a reservoir (29).

15 Claims, 4 Drawing Sheets

CONTROL VALVE FOR PRIME MOVER SPEED CONTROL IN HYDRAULIC SYSTEMS

TECHNICAL FIELD

The invention relates to hydraulic valves and methods for control of hydraulic function cylinders in mobile hydraulic equipment.

BACKGROUND ART

Wilke, U.S. Pat. No. 4,693,272, discloses a basic reciprocal spool control valve for use in controlling hydraulic cylinders on various types of mobile hydraulic equipment. This type of valve can take the form of a sectional valve, several of which may be used together. Such valves are used to control multiple functions, such as raising and lowering mechanical members, tilting or rotating the members around other axes of motion, and sliding members fore and aft.

Prior to the invention herein, there was an operational problem in the art in that the operator of such equipment had to simultaneously manage two separate controls on the machine to achieve optimum cylinder actuation. When the spool actuating lever Was operated to provide hydraulic fluid to a cylinder, an increase in the rotational velocity of the prime mover was also needed to produce the required hydraulic pressure and flow. It has therefore been desirable to find some improved method for simultaneous of control of these functions.

Additional valves with linkages could be added to the prior hydraulic function control valve to control the speed of the prime mover.

This would be disadvantageous in adding to the space previously occupied by a control valve of the prior art. It would also add to the mechanical complexity of the system, in order to support additional functions.

SUMMARY OF THE INVENTION

The invention relates to hydraulic valves and methods for improved hydraulic control of operating cylinders in relation to the rotational velocity of a prime mover source for a piece of mobile or stationary hydraulic equipment.

The invention provides a valve that is an integration of two interrelated control valves in one housing.

The invention provides a hydraulic valve assembly for controlling hydraulic cylinder actuation, while also controlling the rotational velocity of a prime mover source that drives a hydraulic pump that provides hydraulic supply pressure and flow.

The hydraulic valve assembly includes a housing that forms a first flow path for communicating hydraulic fluid from the hydraulic pump to the operational hydraulic cylinder.

A spool is positioned in a bore in the housing to move inward relative to the housing from a first position to a second position. The spool has an output signal port from which a hydraulic pressure signal is transmitted to a prime mover control cylinder to control the rotational velocity of the prime mover.

The output signal is controlled by a reciprocating valve member that is disposed in a bore within the spool. The reciprocating valve member is spring-loaded when the spool is moved from the first position to the second position. The reciprocating valve member is responsive to the hydraulic pressure of the fluid received through the second flow path to counteract the spring load acting on the reciprocating valve member. This closes off the hydraulic signal passage and limits the hydraulic pressure signal to approximately the pressure created by the spring load and the effective area defined by the reciprocating valve member.

The invention thus provides a system for simultaneous control of the prime mover and hydraulic cylinder actuation that is more convenient to use than prior systems, in that the operator need only operate a single control lever.

The invention overcomes the problem of an increase in mechanical complexity and the problem of providing linkages to additional valves to control the speed of the prime mover.

The invention provides a valve that will operate with both single-action and double-action hydraulic cylinders controlling various functions on mobile and stationary hydraulic equipment.

The invention provides a compact valve that is economical to manufacture for the additional functions provided.

Other objects and advantages, besides those discussed above, will be apparent to those of ordinary skill in the art from the description of the preferred embodiment that follows. In the description, reference is made to the accompanying drawings, which form a part hereof, and which illustrate examples of the invention. Such examples, however, are not exhaustive of the various embodiments of the invention, and, therefore, reference is made to the claims which follow the description for determining the scope of the invention.

DETAILED DESCRIPTION OF THE PREFERRED EMBODIMENT

Figure 1:
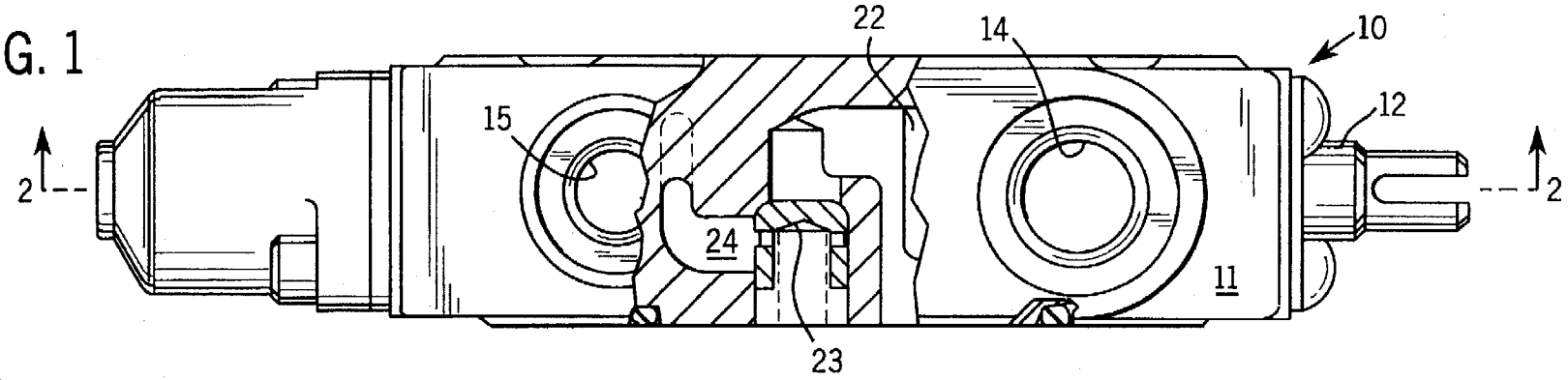
FIG. 1 is a top view, with parts broken away, of a valve constructed in accordance with the invention.
Figure 2:
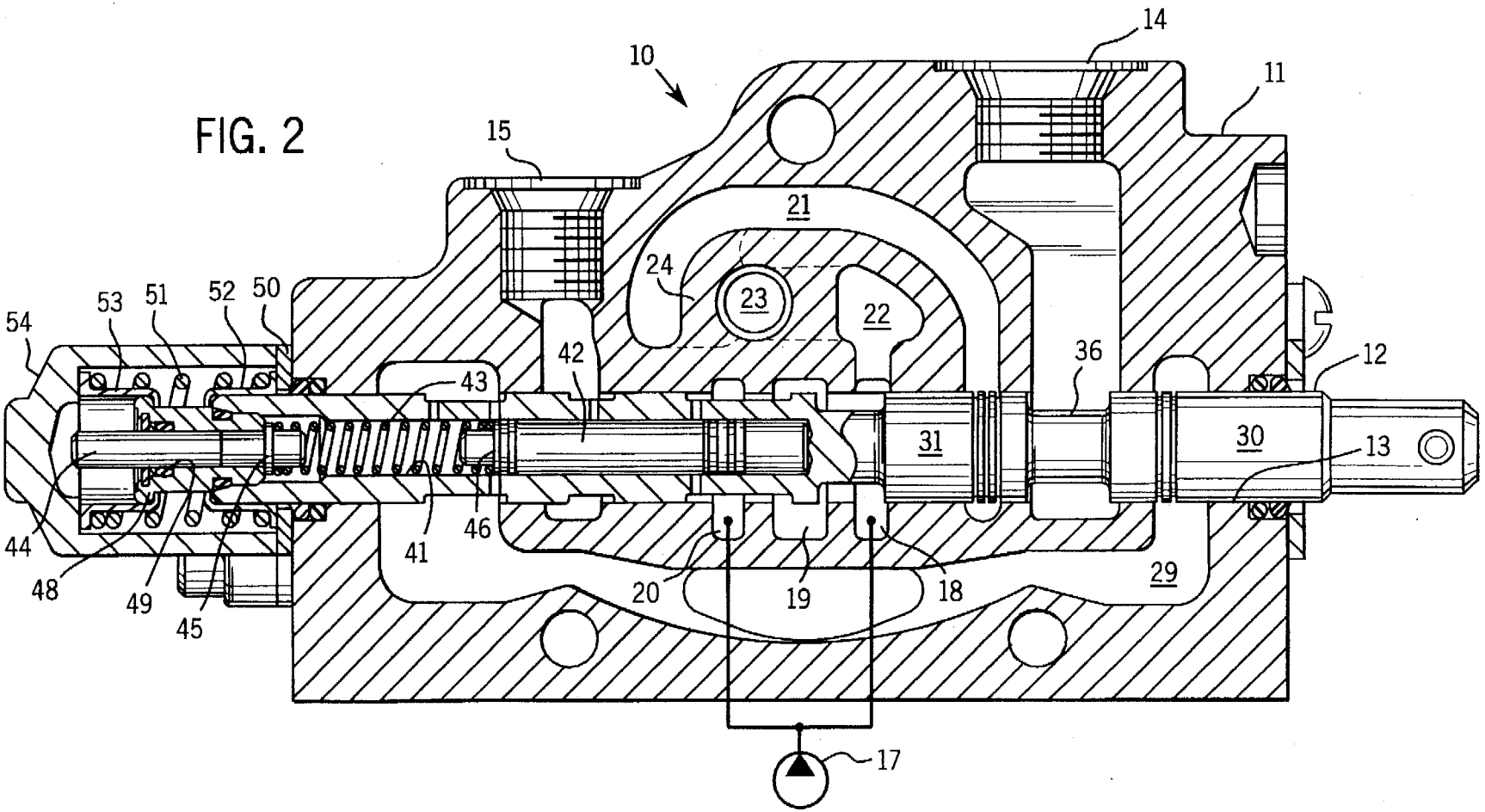
FIG. 2 is a sectional view of the valve of FIG. 1 with a spool in the "NEUTRAL" position.

A 3-position directional valve assembly 10 (FIGS. 1 and 2) according to the present invention has a main valve housing 11. A main valve spool 12 moves laterally within a transverse bore 13 (FIG. 2) in the housing 11 to open and close passages communicating hydraulic fluid to work ports 14, 15 (FIGS. 1 and 2). The spool 12 is mechanically coupled at the right end to a control lever (not shown), which can be operated to move the spool 12 axially to the right or to the left. The spool 12 is initially positioned in its "NEUTRAL" position (FIG. 2). When the spool 12 is in the "NEUTRAL" position (FIG. 2), the cored passage 21 is vented to a reservoir 29 through vent passages (not shown).

If the spool 12 is moved inwardly, or to the left, from the position in FIG. 2, it will reach a next position (FIG. 3) corresponding to a "CYLINDER EXTEND" position. In the "CYLINDER EXTEND" position, fluid is supplied at suitable supply pressure to the hydraulic implement cylinder 16

Figure 5:
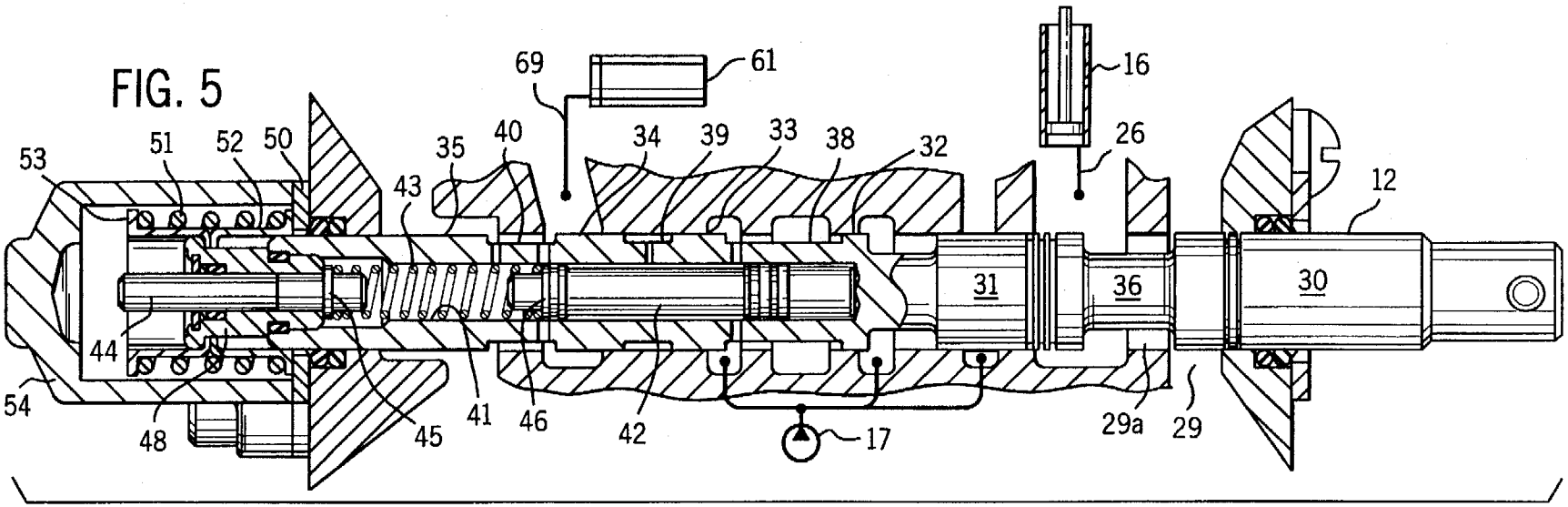
FIG. 5 is an enlarged detail view of the valve of FIG. 2 in the "CYLINDER RETRACT" position.

(FIG. 3) to move the piston 28 in a "CYLINDER EXTEND" operation. If the spool 12 is drawn outwardly, or to the right from the position in FIG. 2, it will reach a next position corresponding to a "CYLINDER RETRACT" position (FIG. 5). In the "CYLINDER RETRACT" position, fluid is drained from the implement cylinder 16 through a passage 29*a* (FIG. 5) to reservoir 29 to allow the piston 28 to return to its lowermost starting position.

A hydraulic pump 17 (FIG. 2) provides hydraulic fluid at a predetermined system pressure to supply passages 18, 19 and 20. From supply passage 18, fluid is communicated to cored passage 21 through riser passage 22, from check valve 23 and cross passage 24.

Figure 3:
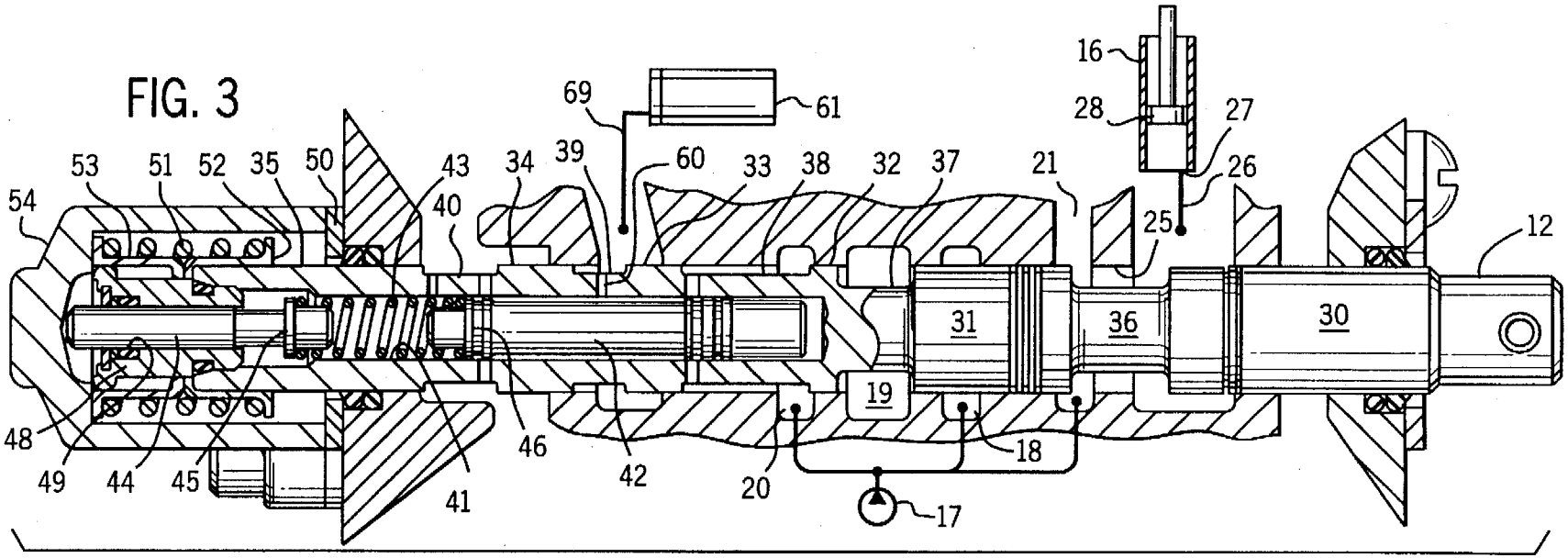
FIG. 3 is an enlarged detail view of the valve of FIG. 2 in the "CYLINDER EXTEND" position.

When the spool 12 is moved to the "CYLINDER EXTEND" position (FIG. 3), fluid in the cored passage 21 flows through a first spool passage 25 (FIG. 3) to a work port 14 (FIGS. 1 and 2). Work port 14 is connected through a hydraulic line 26 to an inlet/outlet port 27 on implement cylinder 16 (FIG. 3). In this embodiment, fluid is introduced and removed from the same side of the piston 28 in cylinder 16. In other embodiments, a double-acting cylinder could be used, and in that event, a second cylinder port would be provided on the opposite side of piston 28 for removal of fluid from implement cylinder 16. In still other embodiments, rotational devices can be used as an alternative to the operational hydraulic cylinders such as implement cylinder 16.

As seen in FIG. 2, the spool 12 also has a bore 41 extending axially inward from an end opposite the control lever (not shown). The components of a pressure reducing shuttle valve are assembled in this spool bore 41. A reciprocating shuttle valve member 42 is positioned in the bore 41 for sliding movement, and is held against an inner end of the spool bore 41 by coiled compression spring 43 and plunger 44. The plunger 44 is formed as a cylindrical member with a circular flange 45 that bears against one end of the compression spring 43. The reciprocating valve member 42 is also cylindrical and is formed with a circular flange 46 that captures the other end of the compression spring 43. The plunger 44 is limited in its backward travel by flange 45 and by plug member 48 inserted in an open end of the spool bore 41. Suitable hydraulic seals are provided between plug member 48 and the inner wall of the spool bore 41, and between plunger 44 and a bore 49 (FIGS. 2 and 3) through the plug member 48.

As further illustrated in FIG. 2, a first annular spring cage retainer 52 is mounted on the innermost end of the spool 12. Retainer 52 moves with spool 12 to compress spool return spring 51 against a second annular spring cage retainer 53 and the inside of spring cap 54. A plug member 48 is mounted for sliding movement within the second spring cage retainer 53 to carry plunger 44. As the spool 12 moves further inward, the tip of plunger 44 meets the inside wall of a spring cap 54 which compresses spring 43. Spring cap 54 is attached in a fixed position on one side of the main valve housing 11.

As seen in FIG. 3, when the spool 12 moves inward from the "NEUTRAL" position to the "CYLINDER EXTEND" position spool return spring 51 is compressed by a flange on spring cage retainer 52 and the limitation of movement of spring cage retainer 53 against spring cap 54.

As seen in FIG. 5, when the spool 12 moves outward from the "NEUTRAL" position to the "CYLINDER RETRACT" position, it also loads the spool return spring 51 by action of the annular spring cage retainer 53 and the limitation of movement of spring cage retainer 52 against wall 50. A flange on the second spring cage retainer 53 compresses the spool return spring 51 as the spool 12 moves outward from the "NEUTRAL" position to the "CYLINDER RETRACT" position seen in FIG. 5.

Figure 4:
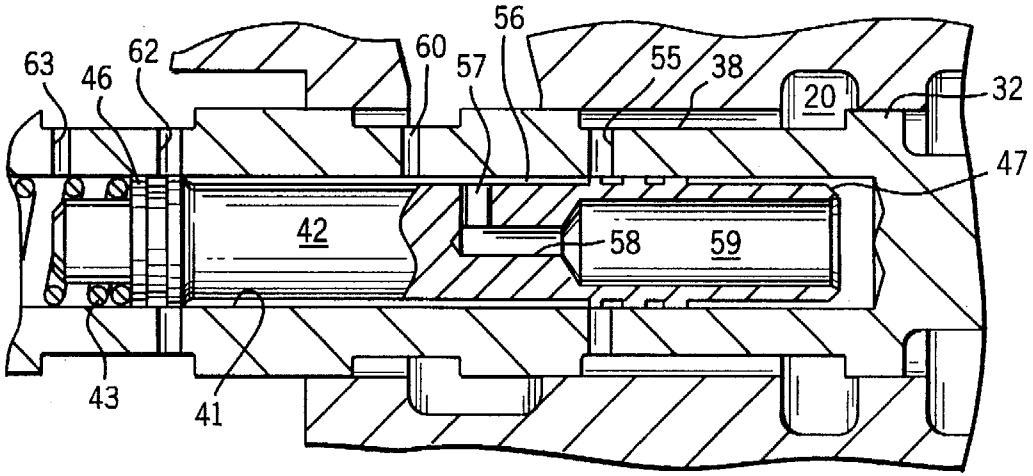
FIG. 4 is an enlarged detail view of the valve of FIG. 3.

As further seen in FIGS. 2, 3 and 5, the spool 12 is formed with lands 30, 31, 32, 33, 34 and 35 alternating with circular grooves or recesses 36, 37, 38, 39 and 40. The middle groove or recess 38 (FIG. 4) provides a high pressure passage for fluid to flow from supply passage 20 to a high pressure inlet port 55 (FIG. 4) that communicates through the wall of spool 12 into the spool bore 41. The reciprocating valve member 42 has a shaft of reduced outer diameter that forms axially extending passage 56 (FIG. 4). A radial connecting passage 57 (FIG. 4) communicates through the wall of reciprocating valve member 42 into an axial bore 58 (FIG. 4) that leads into a larger bore forming an output pressure signal chamber 59 (FIG. 4). First, fluid flows through passages 56, 57 and 58 and collects inside the spool bore 41 to apply pressure to a surface 47 (FIG. 4) on one end of the reciprocating valve member 42. This pressure acting on surface 47 moves the reciprocating valve member 42 to the left against spring 43, which is then compressed.

Figure 6:
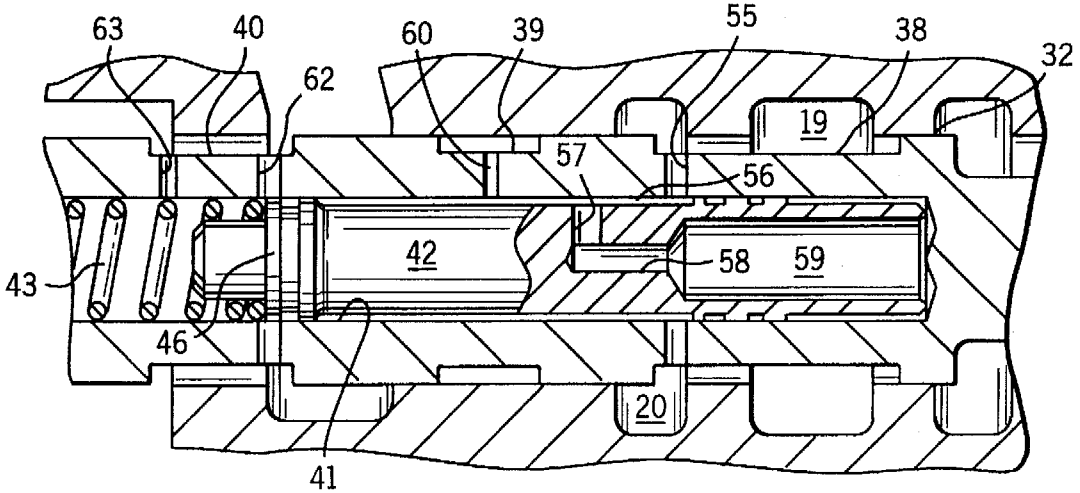
FIG. 6 is an enlarged detail view of the valve of FIG. 5.

Still referring to FIG. 4, to the left of the passage 56, in the recess 39 of the spool 12, is output signal port 60 for signaling a reduced hydraulic pressure signal, less than the system supply pressure, to a hydraulic cylinder 61 (FIG. 3) that controls the speed of the prime mover. This signal is transmitted through work port 15 (FIG. 2) and hydraulic line 69 (FIG. 3) to prime mover control cylinder 61 (FIG. 3). To the left of signal port 60 (FIG. 4), there is a first drain port 62 (FIG. 4) for drainage of fluid from the output signal chamber 59. When valve member 42 slides left to close off inlet port 55, passage 56 is placed in communication with drain port 62 (e.g. FIG. 6). To the left of drain port 62, is a second drain port 63 (FIG. 4) for drainage of fluid leaking into the chamber for spring 43.

The operation of the directional valve assembly 10 will now be described. Upon inward actuation of the spool 12 to the "NEUTRAL" position in FIG. 2, the plunger 44 (FIG. 3) comes into contact with the inside of the spring cap 54. Once contact is made between the plunger 44 and the spring cap 54, any additional inward movement by the spool 12 will cause the plunger 44 to move against spring 43, thus compressing it (FIG. 3) and providing a force against reciprocating valve member 42. The magnitude of the output signal from port 60 is directly proportional to the hydraulic pressure that is necessary to move the reciprocating valve member 42 against the force or pressure created by mechanical loading of the spring 43 by the plunger 44. The pressure of the hydraulic signal from the output signal port 60 increases approximately linearly in relation to inward movement of the spool 12.

Prime mover speed control is active when the spool is either in the "NEUTRAL" position shown in FIG. 2 or in the "CYLINDER EXTEND" position shown in FIG. 3. In the "CYLINDER EXTEND" and "NEUTRAL" positions, the position of the spool 12 allows hydraulic fluid under pressure to flow through the high pressure chamber 38, high pressure port 55 and passages 56 and 57 (FIG. 4). Once inside the output signal chamber 59, the pressurized hydraulic fluid acts upon the effective area 47 defined by the outside diameter of the reciprocating valve member 42 and generates an opposite hydraulic force equivalent to the mechanical force produced by the spring 43. This causes the reciprocating valve member 42 to move left to close off the high pressure port 55 from the passage 56 (FIG. 4). This reduces the magnitude of the pressure in the output signal chamber 59.

Once the communication path between the high pressure supply port 55 and the output signal chamber 59 is closed by the reciprocating valve member 42, which is shifted due to the increasing hydraulic force, the communication path is available from output signal chamber 59 to the low pressure port 62, which reduces the pressure of the hydraulic output signal. When the output signal chamber 59 is vented through drain port 62, the magnitude of mechanical forces becomes greater than the hydraulic force, and starts to re-open the communication path between the high pressure supply port 55 and the output signal chamber 59. As soon as the path between the high pressure supply port 55 and the output signal chamber 59 begins to open, hydraulic force acting on the reciprocating valve member 42 begins to close the communication, and re-open the path from the output signal chamber 59 to the drain port 62. The opening and closing cycle occurs around what is referred to as the "null point." The term "approximately" in reference to the output pressure signal shall mean the pressure at the null point and the variations around the "null" point as described.

Figure 7:
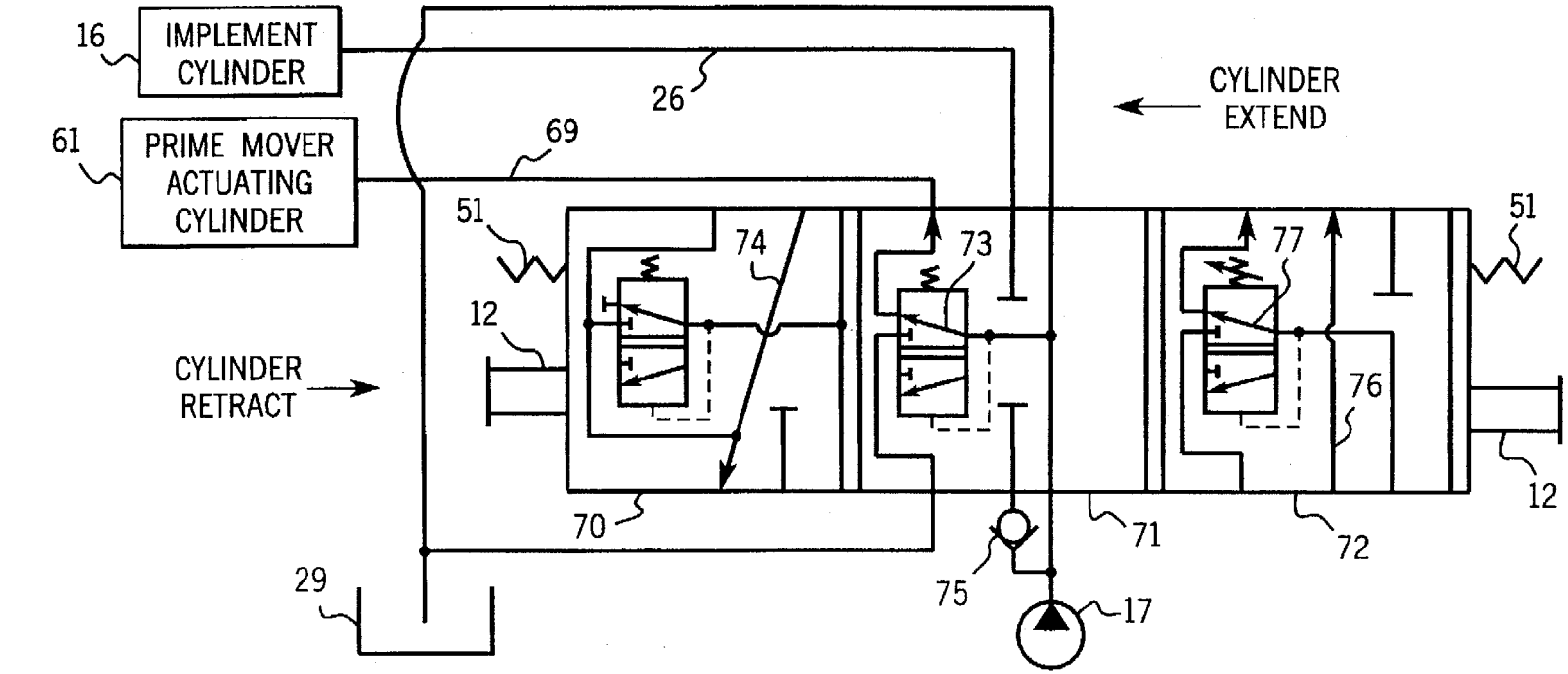
FIG. 7 is schematic of the valve of FIGS. 1–6, showing its operation in three positions.

FIG. 7 shows an alternative, schematic representation of a 3-position valve assembly 10 of the present invention. The three positions are the "CYLINDER RETRACT" position, represented by the section diagram on the left 70, "NEUTRAL" represented by the section diagram in the middle 71, and "CYLINDER EXTEND", represented by the section diagram on the right 72. Spool 12 is represented along with return spring 51. In FIG. 7, the middle or "NEUTRAL" diagram is aligned with the supply line 26 from the pump 17. However, the flow from pump 17 does not connect to the supply line to the implement cylinder 16. The flow instead returns to the reservoir 29. The pump 17 supplies fluid through a first flow path 73 through the shuttle valve 42, represented by an arrow. This flow path 73 communicates through a hydraulic line 69 to the prime mover speed control cylinder 61. The shuttle valve 42 is shown with a fixed spring force opposed by hydraulic pressure against the shuttle valve member 42.

If the spool 12 is drawn to the right to a "CYLINDER RETRACT" position in FIG. 7, the section diagram 70 on the left becomes aligned with the supply line from the pump 17. In this operational position, a flow path 74 is provided to drain fluid from implement cylinder 16 to the reservoir 29. The passage through shuttle valve 42 to the prime mover speed control cylinder 61 is blocked, and fluid from the prime mover speed control cylinder 61 is also provided with a path to the reservoir 29.

If the spool 12 is moved inwardly, it will reach the "CYLINDER EXTEND" position, where the right section diagram 72 in FIG. 7 will become aligned with the supply line from the pump 17. The pump 17 supplies fluid through a check valve 75 and flow path 76 to the implement cylinder 16. The pump 17 also supplies fluid through the flow path 77 through the shuttle valve 42, as in the "NEUTRAL" position. The shuttle valve 42 is shown with a variable spring force, which varies as a function of main spool position and which is opposed by hydraulic pressure against the shuttle valve member 42.

From this description, it can be seen how the valve 10 operates in the three different positions, "CYLINDER EXTEND," "NEUTRAL," and "CYLINDER RETRACT." The reciprocating shuttle valve 42 is assembled with spool 12 of valve 10 and uses a reduced pressure signal to control prime mover speed when the valve is actuated. The shuttle valve within the spool 12 communicates a hydraulic pressure signal to the prime mover cylinder 61, when the spool is in either the "NEUTRAL" position or the "CYLINDER EXTEND" position. This speeds up the prime mover in response to control lever being in either the "NEUTRAL" position or the "CYLINDER EXTEND" position without requiring the operator to operate a foot pedal or other prime mover speed control.

This has been a description of how one example of the invention can be carried out. Those of ordinary skill in the art will recognize that various details may be modified in arriving at other detailed embodiments, and these embodiments will come within the scope of the invention.

Therefore, to apprise the public of the scope of the invention and the embodiments covered by the invention, the following claims are made.

We claim:

1. A hydraulic valve assembly (10) for controlling an operational hydraulic cylinder (16), while also controlling the speed of a prime mover that controls a hydraulic pump (17) to control hydraulic supply pressure and flow, the hydraulic valve assembly (10) comprising:

a housing (11) having a bore (13) therein, the housing forming a first flow path (21, 25) for communicating hydraulic fluid from the hydraulic pump (17) to the operational hydraulic cylinder (16);

a spool (12) having a spool bore (41) in one end, the spool (12) being disposed in said housing bore (13) to move inward relative to said housing (11) from a first position to a second position, the spool (12) forming an output signal port (60) from which a hydraulic pressure signal is transmitted to control the speed of the prime mover, and the spool (12) and the housing (11) forming a flow path (20, 38, 55, 56) in communication with said output signal port (60);

a reciprocating valve member (42) disposed in said spool bore (41), said reciprocating valve member (42) being spring-loaded when said spool (12) is moved from said first position to said second position, and said reciprocating valve member (42) providing at least a portion (47) that is in fluid communication with said second flow path (20, 38, 55, 56);

wherein said portion (47) of said reciprocating valve member (42) is responsive to the hydraulic pressure of said fluid received through said second flow path (20, 38, 55, 56) to counteract said spring loading of said reciprocating valve member (42) and to limit the hydraulic pressure signal from said output signal port (60) to approximately the pressure created by said spring loading.

2. The hydraulic valve assembly (10) of claim 1, wherein the spool (12) moves from a first position corresponding to a "CYLINDER RETRACT" position for the operational hydraulic cylinder (16) to a second position corresponding to a "NEUTRAL" position for the operational hydraulic cylinder (16).

3. The hydraulic valve assembly (10) of claim 1, wherein the spool (12) moves from a first position corresponding to a "NEUTRAL" position for the operational hydraulic cylinder (16) to a second position corresponding to a "CYLINDER EXTEND" position for the operational hydraulic cylinder (16).

4. The hydraulic valve assembly (10) of claim 1, wherein the second flow path (20, 38, 55, 56) further comprises a chamber (20) formed by the housing (11), a first recess (38) formed by said spool (12), a port (55) communicating from said recess (38) to said spool bore (41) and a second recess (56) formed by said spool (12).

5. The hydraulic valve assembly (10) of claim 1, further comprising a spring loading mechanism (43, 44) positioned in said spool bore (41) so as to spring load said reciprocating valve member (42) in response to the movement of the spool (12) into the housing from said first position to said second position.

6. The hydraulic valve assembly (10) of claim 5, wherein further inward movement of said spool (12) increases the spring force on said reciprocating member (42) and wherein said pressure of the hydraulic signal from the output signal port (60) increases approximately linearly in relation to said further inward movement of said spool (12).

7. A hydraulic valve assembly (10) comprising:

a housing (11) forming a first flow path (21, 25) for communicating hydraulic fluid from a hydraulic pump (17) to an operational hydraulic cylinder (16);

a spool (12) forming a spool bore (41) and an output signal port (60) from which a hydraulic pressure signal is transmitted to control the speed of a prime mover that drives the hydraulic pump (17), the spool (12) and the housing (11) forming a second flow path (20, 38, 55, 56) in communication with said output signal port (60);

a reciprocating valve member (42) disposed in said spool bore (41), said reciprocating valve member (42) providing at least a portion (47) that is in fluid communication with said second flow path (20, 38, 55, 56);

wherein said portion (47) of said reciprocating valve member (42) is responsive to the hydraulic pressure of said fluid received through said second flow path (20, 38, 55, 56) and the position of the spool (12) to generate a signal from said output signal port (60) to control the speed of said prime mover.

8. The hydraulic valve assembly (10) of claim 7, wherein the spool (12) moves from a first position corresponding to a "CYLINDER RETRACT" position for the operational hydraulic cylinder (16) to a second position corresponding to a "NEUTRAL" position for the operational hydraulic cylinder (16).

9. The hydraulic valve assembly (10) of claim 7, wherein the spool (12) moves from a first position corresponding to a "NEUTRAL" position for the operational hydraulic cylinder (16) to a second position corresponding to a "CYLINDER EXTEND" position for the operational hydraulic cylinder (16).

10. The hydraulic valve assembly (10) of claim 7, wherein the second flow path (20, 38, 55, 56) further comprises a chamber (20) formed by the housing (11), a first recess (38) formed by said spool (12), a port (55) communicating from said recess (38) to said spool bore (41) and a second recess (56) formed by said spool (12).

11. The hydraulic valve assembly (10) of claim 7, further comprising a spring loading mechanism (43, 44) positioned in said spool bore (41) so as to spring load said reciprocating valve member (42) in response to the movement of the spool (12) into the housing from said first position to said second position.

12. The hydraulic valve assembly (10) of claim 11, wherein further inward movement of said spool (12) increases the spring force on said reciprocating member (42) and wherein said pressure of the hydraulic signal from the output signal port (60) increases approximately linearly in relation to said further inward movement of said spool (12).

13. A method for controlling an operational hydraulic cylinder (16), while also controlling speed of a prime mover that controls a hydraulic pump (17) to control hydraulic supply pressure and flow, the hydraulic method comprising:

receiving hydraulic fluid from the hydraulic pump (17) at a control valve (10) having a work port (14), a signal port (15) and a first valve member (12) which controls flow of hydraulic fluid to the work port (14);

supplying hydraulic fluid to the operational hydraulic cylinder (16) from the work port (14) on the control valve (10) when the control valve (10) is in one of three positions;

diverting a portion of the hydraulic fluid from the hydraulic pump (17) through a second valve member (42) within the first valve member to said signal port (15) on the control valve (10) when said control valve (10) is in said one of three positions to transmit a hydraulic signal to control the speed of the prime mover which is driving the hydraulic pump (17) to maintain supply pressure from said hydraulic pump;

moving a single control member to place the control valve in said one of the three positions to supply hydraulic fluid to the operational hydraulic cylinder (16) from the work port (14); and generating said hydraulic signal from said signal port (15) to control the speed of the prime mover in response to the movement of said single control member to said one on the three positions.

14. The method of claim 13, further comprising:

spring loading the second valve member (42) in response to movement of said single control member to control the hydraulic pressure signal from said output signal port (15) to approximately the pressure created by said spring loading.

15. The method of claim 13, wherein said first valve member is moved to a "CYLINDER EXTEND" position for the operational hydraulic cylinder (16).

* * * * *